United States Patent [19]

Walsh

[11] Patent Number: 4,703,848

[45] Date of Patent: Nov. 3, 1987

[54] PACKAGE INTERLOCK AND ALIGNMENT SYSTEM

[75] Inventor: Joseph C. Walsh, Longmont, Colo.

[73] Assignee: Adolph Coors Company, Golden, Colo.

[21] Appl. No.: 811,411

[22] Filed: Dec. 20, 1985

[51] Int. Cl.[4] ..... B65D 5/46; B65D 5/48

[52] U.S. Cl. ..... 206/171; 206/188; 206/198

[58] Field of Search ..... 206/188, 162, 164, 165, 206/170, 171, 193, 198, 142, 143, 144, 198

[56] References Cited

U.S. PATENT DOCUMENTS

| | | | |
|---|---|---|---|
| 3,151,769 | 10/1964 | Woodling | 206/188 |
| 3,208,633 | 9/1965 | Graser . | |
| 3,567,069 | 3/1971 | Harrelson . | |
| 3,827,550 | 8/1974 | Arneson . | |
| 4,144,966 | 3/1979 | Kulig | 206/188 |
| 4,258,844 | 3/1981 | Stout | 206/188 |
| 4,308,950 | 1/1982 | Wood | 206/188 |
| 4,362,240 | 12/1982 | Elward | 206/188 |
| 4,450,956 | 5/1984 | Wood | 206/188 |
| 4,465,181 | 8/1984 | Wood | 206/188 |

*Primary Examiner*—Joseph Man-Fu Moy

*Attorney, Agent, or Firm*—Klaas & Law

[57] ABSTRACT

A multi-cell, basket-type carrier is provided with a combination mechanical interlock and an alignment means comprising a tongue portion which during a sequence of operations passes through a slot formed in a pair of riser panels and cooperates therewith so that the tongue portion is properly positioned in a superposed and aligned relationship with a handle portion and a portion of the riser panels is positioned between the tongue portion and the handle portion to form a mechanical interlock between the handle portion and the rest of the multi-cell, basket-type carrier.

10 Claims, 5 Drawing Figures

PACKAGE INTERLOCK AND ALIGNMENT SYSTEM

FIELD OF THE INVENTION

This invention relates generally to a package for storing and carrying objects, such as beverage bottles, and more particularly to a multi-cell, basket type carrier for objects, such as beverage bottles, which carrier is provided with mechanical interlock and alignment means to form a safe and attractive carrier.

BACKGROUND OF THE INVENTION

In the manufacture of carriers used to package products, such as cans or bottles containing liquids or other similar materials, from paperboard materials, it is customary to use a sheet of continuous length of the paperboard material. The sheet of continuous length is processed through conventional apparatus to form a plurality of carrier blanks having cut, fold and score lines therein. The carrier blanks are then processed through conventional apparatus wherein the carrier blanks are folded in a series of operations to form folded carriers. It is customary to form folded carriers from the carrier blanks at the rate between about 350 and 400 carriers per minute.

One of the problems associated with forming folded carriers from carrier blanks at these rates of production is that of ensuring that the various portions of the carrier blank are in proper alignment during the folding operations. This is necessary for appearance and safety considerations. If portions of the folded carrier are not in alignment, the resulting carrier will not be as attractive as it was planned to be. Also, if the misaligned portions are adhesive containing portions, the resulting carrier will not be as safe as planned. Also, the apparatus for inserting the bottles into the carriers operates at approximately the same rates of speed at which the folded carriers are formed and is constructed with structures that are adapted to receive portions of the folded carrier at specific locations. If these portions of the folded carrier are not at the specific locations because of misalignment of these portions, the production line must be shut down. At the above described rates of speed, it is readily apparent that any production downtime resulting from a misalignment of portions of a folded carrier is very serious.

BRIEF DESCRIPTION OF THE INVENTION

This invention provides method and structure for use in folding carrier blanks into folded carriers wherein an alignment system is provided for ensuring proper alignment of various portions, particularly the portions forming the handle, of the resulting carrier and a mechanical interlock is provided for joining the handle to the rest of the carrier.

In a preferred embodiment of the invention, a relatively flat carrier blank having oppositely facing planar surfaces has a tongue portion formed therein with one end of the tongue portion connected to a handle portion by a fold line and the other end of the tongue portion having a cut line so that it can be separated from the carrier blank so as to be free to move. The portion of the carrier blank comprising the riser panels is provided with a slot having an opening formed therein. The riser panels are connected to a pair of end wall panels by fold lines and the pair of end panels are connected to a pair of side wall panels by fold lines. A center fold line extends across the carrier blank and is used to pivotally connect identical portions of the handle portion, the tongue portion, the pair of end wall panels, the pair of riser panels and the slot. During the folding of the carrier blank, the tongue portion is folded around the fold line connecting it to the handle portion and the end panels, the riser panels and the slot are folded around the fold line connecting the end panels to the side wall panels in a simultaneous operation. Sufficient force is applied to the tongue portion during the simultaneous folding operation to ensure that the tongue is in contact with the wall of the slot opposite to the opening so that the tongue portion is guided to a superposed relationship with the handle portion and the fold line in the tongue portion is in alignment with the fold line in the handle portion. During the simultaneous folding operation, a continuous strip, comprising a portion of each riser panel, is located between the tongue portion and the handle portion so that when the tongue portion is in the superposed relationship with the handle portion, a portion of the continuous strip is located therebetween. Therefore, after the simultaneous folding operation has been completed, the portions of the center fold line in a portion of the handle portion, the continuous strip and a portion of the tongue portion are in a superposed and aligned relationship. Also, the continuous strip provides a mechanical interlock between the handle portion and the riser panels.

In another folding operation, another pair of riser panels, connected to each other by a portion of the center fold line, have portions thereof connected to a portion of the handle portion by a fold line so that when the another pair of riser panels are folded around that fold line, portion of the center fold line connecting the another pair of riser panels is in a superposed and aligned relationship with a portion of the common fold line in a portion of the handle portion. Also, when the simultaneous folding operation has been completed, the portion of the common fold line located in the tongue portion adjacent to the free end thereof is in a superposed and aligned relationship with the portion of the common fold line connecting the another pair of riser panels and the portion of the common fold line in the portion of the handle portion.

It is an object of this invention to provide method and structure to ensure that various portions of a folded multi-cell, basket type carrier are in proper alignment.

It is another object of this invention to provide a mechanical interlock for joining the handle of a multi-cell, basket type carrier to the other portions of the carrier.

It is a further object of this invention to provide a multi-cell, basket type carrier wherein alignment means and mechanical interlock means have a common relationship.

Additional objects, advantages, and novel features of the invention are set forth in part in the description which follows which will be understood by those skilled in the art upon examination of the following or may be learned by practice of the invention. The objects and advantages of the invention may be realized and obtained by mean of the instrumentalities and combinations particularly pointed out in the appended claims.

DETAILED DESCRIPTION OF THE INVENTION

Figure 1:
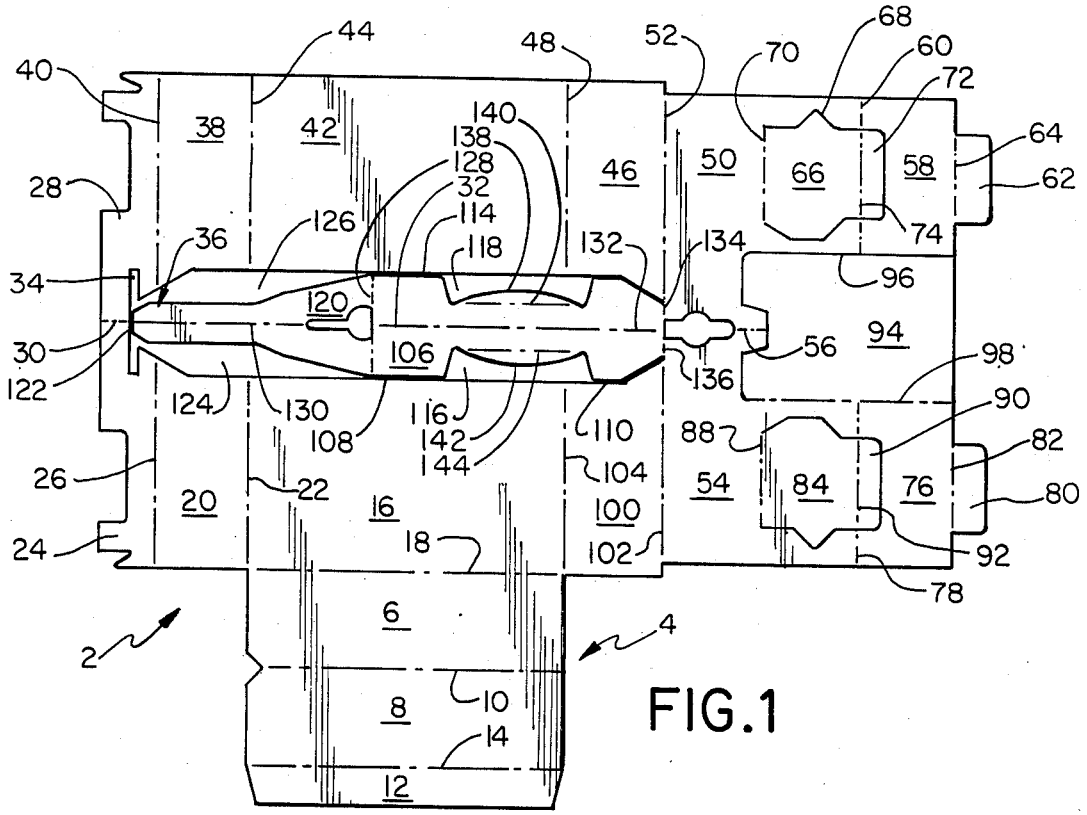
FIG. 1 is a plan view of a carrier blank illustrating one embodiment of the invention.

Referring to the drawings, FIG. 1 illustrates a one piece carrier blank 2 of paperboard material, preferably a composite material, such as that described in U.S. Pat. No. 4,254,173 to A. D. Peer, Jr., having glue patterns, fold lines and cut lines illustrated in a conventional manner. A bottom wall panel 4 comprising two sections 6 and 8 connected by a fold line 10 is provided with a glue tab 12 connected thereto by a fold line 14. The section 6 of the bottom wall panel 4 is connected to a side wall panel 16 by a fold line 18. An end wall panel 20 is connected to side wall panel 16 by fold line 22 and to a riser panel 24 by a fold line 26. The riser panel 24 is connected to a correspondingly shaped riser panel 28 by a fold line 30 which is part of a center fold line 32 extending across the carrier blank 2. A continuous slot 34 is formed in adjacent portions of the riser panels 24 and 28 and is provided with an opening 36.

The riser panel 28 is connected to an end wall panel 38, which is shaped similar to end wall panel 20, by a fold line 40. A side wall panel 42 is connected to end wall panel 38 by fold line 44 and to end wall panel 46 by fold line 48. The end wall panel 46 is connected to a riser panel 50 by a fold line 52. The riser panel 50 is connected to a similarly shaped riser panel 54 by a fold line 56 which is a part of the center fold line 32.

A cross partition panel 58 is connected to the riser panel 50 by a fold line 60. A glue tab 62 is connected to cross partition panel 58 by a fold line 64. Another cross partition panel 66 is formed in the riser panel 5 by cut line 68 and is connected to the riser panel 50 by fold line 70. A cut line in this application is a conventional cut line wherein the component is held in position by small tabs that are readily severable. A glue tab 72 is connected to cross partition panel 66 by fold line 74. Another cross partition panel 76 is connected to riser panel 54 by fold line 78. A glue tab 80 is connected to cross partition panel 76 by a fold line 82. Another cross partition panel 84 is formed in the riser panel 54 by cut line 86 and is connected to riser panel 54 by fold line 88. A glue tab 90 is connected to cross partition panel 84 by fold line 92.

A reinforcing tab 94 is formed in riser panels 50 and 54 by cut line 96 and is connected to riser panel 54 and cross partition panel 76 by a combination cut and fold line 98.

An end wall panel 100 is connected to the riser panel 54 by fold line 102 and is connected to side wall panel 16 by fold line 104.

A handle 106 is formed in the carrier blank 2 by cut lines 108, 110, 112 and 114 and openings 116 and 118 are cut out of the carrier blank 2. A tongue portion 120 is formed by cut line 122 and openings 124 and 126 cut out of the carrier blank 2. The tongue portion 120 is connected to the handle 106 by fold line 128. A part 130 of the center fold line 32 is formed in tongue portion 120 and a part 132 of the center fold line 32 is formed in handle 106. The riser panel 50 is connected to the handle 106 by fold line 134 and the riser panel 54 is connected to the handle 106 by fold line 136. A tab 138 is connected to the handle 106 by fold line 140 and a tab 142 is connected to the handle 106 by fold line 144.

Figure 2:
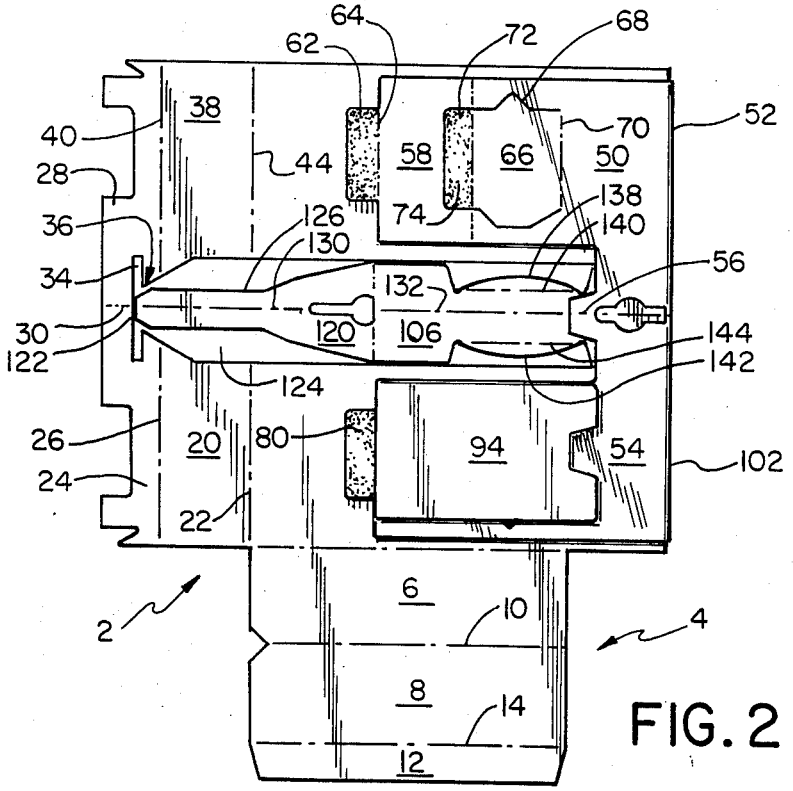
FIG. 2 is a plan view after two folds have been made.
Figure 5:
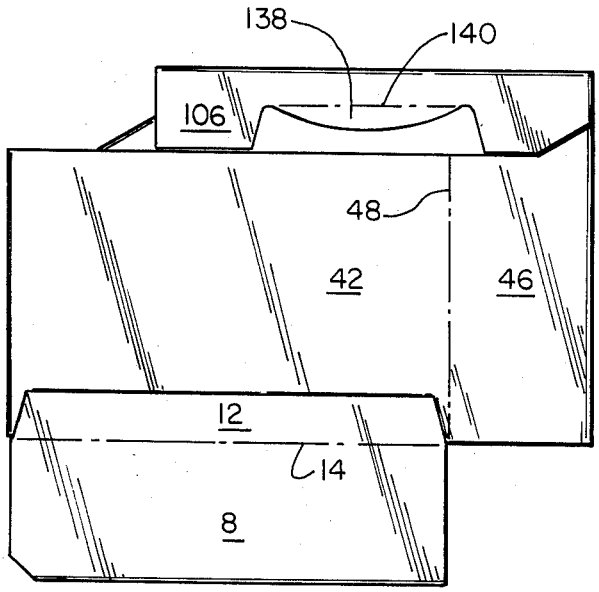
FIG. 5 is a plan view of the fully folded carrier in a collapsed condition.

The folded carrier illustrated in FIG. 5 is formed by a sequence of folding operations. The first fold (not illustrated) comprises severing the reinforcing tab 94 along cut line 96 and folding around fold line 98 until it is in a position under a portion of riser panel 56, cross partition means 84 and cross partition means 76, as viewed looking at FIG. 1. The next folding operation is to fold riser panels 50 and 54 around fold lines 52 and 102 until the riser panels 50 and 52 are in a superposed position, illustrated in FIG. 2, over portions of the side wall panels 14 and 42 and over end wall panels 46 and 100. The handle 106 is visible through the opening formed by the folded reinforcing tab 94.

Figure 3:
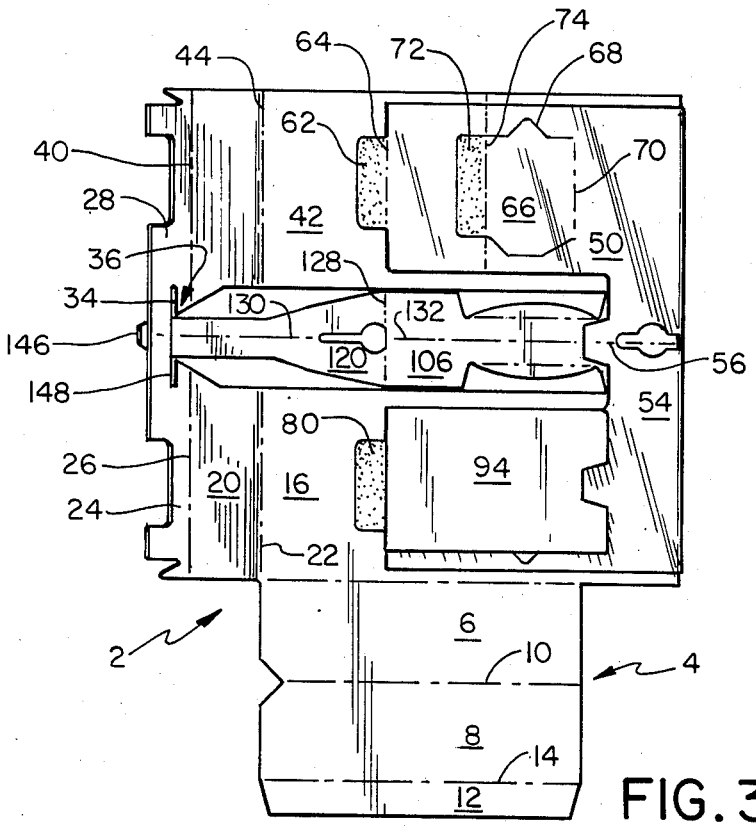
FIG. 3 is a plan view illustrating an intermediate position during a simultaneous folding operation.
Figure 4:
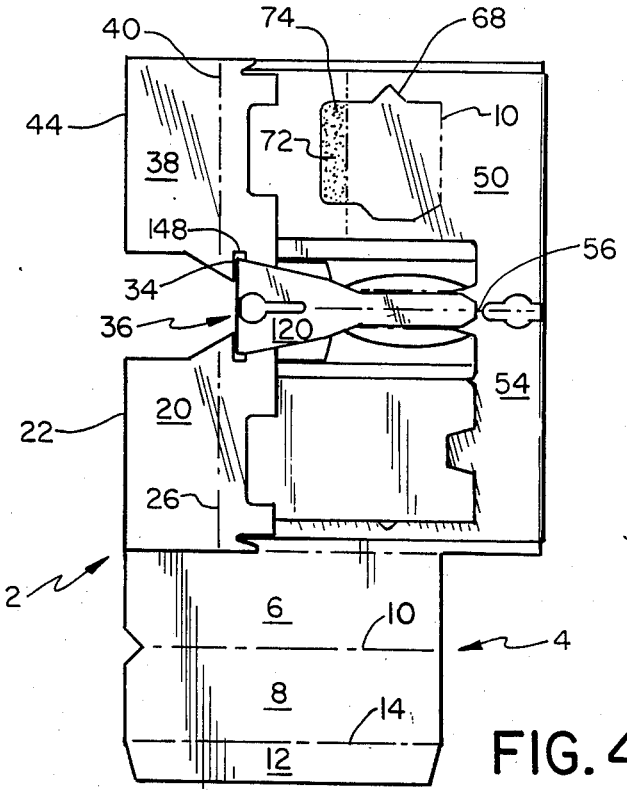
FIG. 4 is a plan view after the simultaneous folding operation has been completed.

The folding operation illustrated in FIGS. 3 and 4 is a significant part of this invention and comprises the simultaneous folding of the end wall panels 20 and 38 around fold lines 22 and 44 and the tongue portion 120 around the fold line 128. As illustrated in FIG. 3, the simultaneous folding has moved the end wall panels 20 and 38 and the tongue 120 through approximately 45 degree. During this folding the riser panels 24 and 28 and the slot 34 move with the end wall panels 20 and 38.

As illustrated in FIG. 3, the free end 146 of the tongue portion 120 has moved through the slot 34. Sufficient force is applied to the tongue portion 120 so that the tongue portion 120 is in contact with the edge 148 of the slot 34 during the simultaneous folding operation. It is noted that the width of the free end 146 of the tongue portion 120 is less than the width of the opening 36 and that the width of the tongue portion 120 adjacent the fold line 128 is greater than the width of the opening 36 but less than the width of the slot 34. The simultaneous folding is continued until the tongue portion 120 is in superposed relationship with a portion of the handle portion 106 as illustrated in FIG. 4. Also, the tip 146 of the tongue portion 120 is in superposed relationship with the portions of riser panels 50 and 54 adjacent to the fold line 56. In the position illustrated in FIG. 4, all of the portions 30, 56, 130 and 132 of the center fold line 32 are in a superposed and aligned relationship. This ensures that when the final fold has been made that edges defined by the fold lines 22 and 24 and the fold lines 52 and 102 will be properly aligned.

The simultaneous folding operation also produces a mechanical interlock between the handle portion 106 and tongue portion 120 and the riser panels 24 and 28. As illustrated in FIGS. 3 and 4, the contact between the tongue portion 120 and the edge 148 of the slot 34 moves portions 150 and 152 of the riser panels 24 and 28 on either side of the fold line 30 to a position sandwiched between a portion of the tongue portion 120 and a portion of the handle portion 106. Therefore, when the final folds have been made as illustrated in FIG. 5, the continuous strip formed by the portions 150 and 152 will provide a mechanical interlock joining the riser panels 24 and 28 to the tongue portion 120 and the handle portion 106.

It is contemplated that the inventive concepts herein described may be variously otherwise embodied and it is intended that the appended claims be construed to include alternative embodiments of the invention except insofar as limited by the prior art.

What is claimed is:

1. A carrier blank cut and scored to form a plurality of panels capable of being folded to form a multi-cell, basket type carrier comprising:

a center fold line extending across a portion of said carrier blank;

handle defining means for providing a handle are located on each side of a first portion of said center fold line;

reinforcement means for providing a reinforcement for said handle are located on each side of a second portion of said center fold line;

panel means defining a pair of riser panels are located on each side of a third portion of said center fold line;

slot defining means for providing a slot having a portion in each of said pair of riser panels and located on each side of said center fold line;

opening defining means for providing an opening in said slot, said opening having a portion on each side of said center fold line; and a portion of said reinforcement means extending through said opening and being removably secured to a portion of said slot defining means.

2. A carrier blank as in claim 1 wherein said reinforcement means for providing reinforcement for said handle comprises:

a tongue having one end thereof secured to said handle by a fold line and the other end thereof secured to said slot defining means by a cut line so as to be readily separable from said slot defining means;

a first section of said tongue, adjacent to said fold line connecting said tongue to said handle, extends in each direction away from said center fold line for a distance greater than the distance a second section of said tongue adjacent to said other end extends in each direction away from said center fold line.

3. A carrier blank as in claim 2 and further comprising:

said second section of said tongue extends in each direction away from said center fold line for a distance less than the distance said means defining an opening extends in each direction away from said center fold line; and a portion of said second section of said tongue being located in said slot.

4. A carrier blank as in claim 3 and further comprising:

said first section of said tongue extends in each direction away from said center fold line for a distance greater than the distance said opening extends in each direction away from said center fold line but less than the distance said slot defining means extends in each direction away from said center fold line.

5. A carrier blank as in claim 4 and further comprising:

a pair of end panels connected by a fold line to said pair of riser panels, one of said end panels being located on each side of said center fold line;

a pair of side wall panels connected by a fold line to said pair of end panels, one of said side wall panels being located on each side of said center fold line.

6. A carrier blank as in claim 5 and further comprising;

the distance from said fold line connecting said tongue to said means defining said handle to said other end of said tongue is proportioned to the distance from said fold line connecting said pair of end panels to said pair of side wall panels to said means defining said slot in said pair of riser panels so that when said pair of end panels and said pair of riser panels are pivoted around said fold line connecting said end panels to said pair of side wall panels and said tongue is pivoted around said fold line connecting said tongue to said means defining a handle said tongue will pass through said mean defining a slot so that in a fully folded condition portions of said pair of riser panels will be located between portions of said first section of said tongue and portions of said means defining a handle.

7. A carrier blank as in claim 6 and further comprising:

means defining another pair of riser panels on each side of a fourth portion of said center fold line;

portions of said another pair of riser panels connected to said means defining a handle by a fold line;

reinforcing means comprising portions of said another pair of riser panels so that when said another pair or riser panels are folded around said fold line connecting portions of said another pair of panels to said means defining a handle said reinforcing means will be in a superposed relationship with portions of said means defining a handle.

8. A multi-cell, basket type carrier comprising:

a plurality of panels secured together to form a basket type carrier for receiving objects;

handle forming means for providing a handle secured to a portion of said plurality of panels;

reinforcement means for providing a reinforcement for said handle superposed over at least a portion of said handle adjacent to one end thereof;

interlocking means for forming a mechanical interlock between portions of said plurality of panels, said reinforcement means and said handle forming means; and said interlocking means being located between a portion of said reinforcement means and a portion of said handle forming means.

9. A multi-cell, basket type carrier as in claim 8 wherein said interlocking means forming a mechanical interlock comprises:

a continuous integral portion of a portion of a pair of said plurality of panels located between a portion of said reinforcement means and a portion of said handle forming means.

10. A multi-cell, basket type carrier as in claim 9 and further comprising:

another reinforcement means superposed over a portion of said handle forming means adjacent to the other end thereof.

* * * * *